US007849959B2

(12) United States Patent
Amir et al.

(10) Patent No.: US 7,849,959 B2
(45) Date of Patent: Dec. 14, 2010

(54) EXHAUST PIPE STRUCTURE FOR VEHICLE

(75) Inventors: Hossain Amir, Shizuoka-ken (JP); Akihiro Fujita, Shizuoka-ken (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 12/544,767

(22) Filed: Aug. 20, 2009

(65) Prior Publication Data

US 2010/0071990 A1 Mar. 25, 2010

(30) Foreign Application Priority Data

Sep. 25, 2008 (JP) ..... 2008-245599

(51) Int. Cl.

| | |
|---|---|
| ***F01N 13/08*** | (2010.01) |
| ***F01N 3/10*** | (2006.01) |
| ***F01N 1/16*** | (2006.01) |
| ***F01N 1/02*** | (2006.01) |
| ***F01N 1/00*** | (2006.01) |
| ***B60K 13/04*** | (2006.01) |
| ***B62K 11/00*** | (2006.01) |

(52) U.S. Cl. ..... 181/228; 181/227; 181/237; 181/251; 181/254; 180/89.2; 180/219; 180/296; 180/309; 60/299; 60/322; 60/323

(58) Field of Classification Search ..... 181/237, 181/227, 251, 254; 180/89.2, 219, 296, 309; 60/299, 323, 322

See application file for complete search history.

(56) References Cited

U.S. PATENT DOCUMENTS

| | | | | |
|---|---|---|---|---|
| 1,613,580 | A * | 1/1927 | Neal | 165/103 |
| 2,483,554 | A * | 10/1949 | Nash | 291/3 |
| 3,035,505 | A * | 5/1962 | Lee | 454/1 |
| 3,404,445 | A * | 10/1968 | Crouse | 29/890.08 |
| 4,159,627 | A * | 7/1979 | Monch et al. | 60/322 |
| 5,697,155 | A * | 12/1997 | Bloecker et al. | 29/890.148 |
| 5,937,642 | A * | 8/1999 | Magarida et al. | 60/323 |
| 6,026,930 | A * | 2/2000 | Ogisu et al. | 181/228 |
| 6,247,305 | B1 * | 6/2001 | Bassani | 60/312 |
| 6,662,554 | B2 * | 12/2003 | Sheidler et al. | 60/290 |

(Continued)

FOREIGN PATENT DOCUMENTS

JP 09-086193 A 3/1997

*Primary Examiner*—Elvin G Enad
*Assistant Examiner*—Christina Russell
(74) *Attorney, Agent, or Firm*—Beem Patent Law Firm

(57) ABSTRACT

A vehicle (1) is provided with an exhaust pipe (2) extending from an engine mounted in the front part of the vehicle to a branch part (24) in the rear part of the vehicle, and right and left branch pipes (25, 26) extending from the branch part to mufflers (5, 6) on both right and left sides. The branch part (24) is arranged so as to be offset to the side of either one muffler (5) of the right and left mufflers with respect to the center in the vehicle width direction; the exhaust pipe has an upstream part (2, 21) laid linearly to a bend part (22) positioned in the center in the vehicle width direction near the rear end of a fuel tank, and an oblique part (23) laid slantwise from the bend part toward the branch part; and the length of the branch pipe (25) having a longer distance to the muffler is approximately equal to the length of the oblique part (23).

8 Claims, 3 Drawing Sheets

U.S. PATENT DOCUMENTS 6,938,729 B2 * 9/2005 Worner et al. ..... 181/254
7,364,010 B2 * 4/2008 Konno ..... 181/228
2002/0175022 A1 * 11/2002 Schumacher et al. ..... 181/254
2003/0079938 A1 * 5/2003 Yamaguchi ..... 181/227
2003/0131594 A1 * 7/2003 Kawamizu ..... 60/299
2005/0028366 A1 * 2/2005 Bien et al. ..... 29/890.148
2005/0115231 A1 * 6/2005 Ashida et al. ..... 60/313
2005/0224273 A1 * 10/2005 Conte ..... 180/309
2006/0175107 A1 * 8/2006 Etou ..... 180/190
2008/0250777 A1 * 10/2008 Fujita ..... 60/299
2008/0251306 A1 * 10/2008 Kobayashi et al. ..... 180/89.2
2009/0014229 A1 * 1/2009 Fujita ..... 180/309
2009/0019841 A1 * 1/2009 Fujita ..... 60/299
2010/0115933 A1 * 5/2010 Ashida et al. ..... 60/299
2010/0192558 A1 * 8/2010 Matsueda ..... 60/322

* cited by examiner

EXHAUST PIPE STRUCTURE FOR VEHICLE

CROSS-REFERENCE TO RELATED APPLICATIONS

This application claims the benefit of priority from Japanese Patent Application No. 2008-245599, filed Sep. 25, 2008.

BACKGROUND OF THE INVENTION

1. Field of the Invention

The present invention relates to an exhaust pipe structure for a vehicle and, more particularly, to an exhaust pipe structure for a vehicle, which can reduce damage at the time when the vehicle is subjected to a rear end offset collision.

2. Description of the related art

On a vehicle mounted with an engine in a front part thereof, an exhaust pipe collected by an exhaust manifold extends to the rear part of the vehicle through a floor tunnel under the lower surface in the vehicle body center, and communicates with the outside air via a muffler disposed in the rear end part of the vehicle. To suppress the output loss of engine caused by exhaust resistance, a sufficient muffler volume must be secured. Therefore, on the vehicle designed with an emphasis on running performance, the muffler is often provided on both right and left sides of the rear end part of the vehicle.

The exhaust pipe of such a dual muffler type vehicle generally branches on the rear of a fuel tank under a rear seat, and is connected to the right and left mufflers via right and left branch pipes. As the layout of the branch pipes, a Y-shaped or T-shaped layout in which the branch pipes are provided at the right and left symmetrically with respect to the vehicle center is generally used (refer to JP9-86193A).

In the case in which a vehicle is subjected to a collision from the rear by another running vehicle, that is, in the case of rear end collision, a full overlap collision and an offset collision are assumed. For example, the former corresponds to a collision of a following vehicle with a vehicle stopping in a traffic lane, and the latter corresponds to a collision of a following vehicle with a vehicle stopping on the shoulder of a road or contact at a road merging point or at the time of lane change. In the case of the offset collision, a rear end collision from the side rear of the driver's seat or from the slantwise rear is assumed.

In the case in which the aforementioned dual muffler type vehicle is subjected to a rear end offset collision, even in a slight degree of collision, a high load is applied to the muffler positioned on the collision side of the rear end part of vehicle body. Thereby, the whole of the exhaust pipe is pushed out to the vehicle front side together with the muffler, so that a primary silencer or a secondary catalyst on the upstream side of the exhaust pipe may be damaged. Especially on the vehicle provided with the branch pipes having a Y-shaped layout, a force such as to push out the exhaust pipe to the vehicle front side via the branch pipes acts strongly, so that the parts arranged on the upstream side are influenced greatly. Also, for the T-shaped branch pipe layout, a branch part may be damaged by the concentration of bending stresses.

BRIEF SUMMARY OF THE INVENTION

The present invention has been made in view of the above circumstances, and accordingly, an object thereof is to provide an exhaust pipe structure in which damage to a branching part of an exhaust pipe and damage to a secondary catalyst or a primary silencer on the upstream side of the exhaust pipe can be reduced in the case in which a shock load is applied to a vehicle body rear part from the slantwise rear.

To achieve the above object, an exhaust pipe structure for a vehicle in accordance with the present invention includes mufflers disposed on both right and left sides in the rear end part of the vehicle; an exhaust pipe extending from an exhaust manifold of an engine mounted in the front part of the vehicle to a branch part in the rear part of the vehicle through a portion under a fuel tank disposed under a rear seat; and right and left branch pipes extending from the branch part to the right and left mufflers, and is characterized in that the branch part is arranged so as to be offset to the side of either one of the right and left mufflers with respect to the center in the vehicle width direction; the exhaust pipe has an upstream part that extends from the exhaust manifold to a bend part positioned in the center in the vehicle width direction near the rear end of the fuel tank and is laid linearly in the center in the vehicle width direction at least in a section ranging from a floor front end part to the bend part, and an oblique part laid slantwise from the bend part toward the branch part; and the length of the branch pipe having a longer distance to the corresponding muffler is approximately equal to the length of the oblique part.

Owing to the above-described characteristics, for the exhaust pipe structure for a vehicle in accordance with the present invention, a shock load is applied to the vehicle body rear part from the rear or the slantwise rear so as to be offset to the side of the muffler connected to the longer branch pipe, and even in the case in which a moment that turns the longer branch pipe forward with the branch part being the center and turns the oblique part of the exhaust pipe to the side is produced by the forward movement of the muffler, since the length of the branch pipe is set so as to be relatively long, the rotation angles of the branch pipe and the oblique part can be kept small, the bending stress of the branch part of the exhaust pipe can be made low, and the damage to the branch part can be reduced.

Also, by the bending part of the exhaust pipe, the thrust against the load applied from the rear is relaxed, and therefore the pushing-out of the exhaust pipe to the front and the damage to the secondary catalyst and the primary silencer arranged on the upstream side of the exhaust pipe caused by the pushing-out can be reduced.

Furthermore, since the branch part of the exhaust pipe and the oblique part connected thereto are arranged so as to be offset to the side with respect to the center in the vehicle width direction, a jack-up point can be provided in the center in the vehicle width direction in that portion. Usually, in this portion, a support frame (sub frame) for a rear suspension is provided, and the jack-up point is provided in the center in the vehicle width direction in the highly rigid portion, by which support rigidity and stability at the jack-up time can be secured.

In the present invention, the main part of each of the branch pipes, which is connected to the branch part, is preferably laid linearly in the vehicle width direction. This mode is advantageous in that even in the case in which the shock load is applied to the vehicle body rear part from the rear, the frontward load applied to the main part of the branch pipe is reduced, and only an allowable range of suspension displacement is transmitted because the rotation angle is kept small, so that the pushing-out of the exhaust pipe to the front and the damage to the secondary catalyst and the primary silencer on the upstream side of the exhaust pipe caused by this pushing-out are reduced.

In the present invention, the exhaust pipe is preferably connected in the bend part or in the vicinity thereof via a pipe joint that allows angular displacement of the exhaust pipe. In this mode, in the case in which a moment that turns the longer branch pipe forward with the branch part being the center and turns the oblique part of the exhaust pipe to the side is produced by the shock load applied to the vehicle body rear part from the rear or the slantwise rear, the angular displacement of the oblique part with respect to the upstream part of the exhaust pipe is allowed by the pipe joint. Thereby, the transmission of load and vibrations to the upstream side of the exhaust pipe is restrained, and the damage to the secondary catalyst and the primary silencer on the upstream side of the exhaust pipe can be reduced further.

In the present invention, the right and left mufflers and the right and left branch pipes are preferably suspended so as to be displaceable in the longitudinal direction to allow rotational displacement in the horizontal plane with the branch part being the center. This mode is advantageous in that in the case in which a moment that turns the longer branch pipe forward with the branch part being the center and turns the oblique part of the exhaust pipe to the side is produced by the shock load applied to the vehicle body rear part from the rear or the slantwise rear, the displacement of the branch pipes is allowed, so that the concentration of stresses on the branch part is relaxed.

DETAILED DESCRIPTION OF THE INVENTION

An embodiment of the present invention will now be described in detail with reference to the accompanying drawings.

Figure 1:
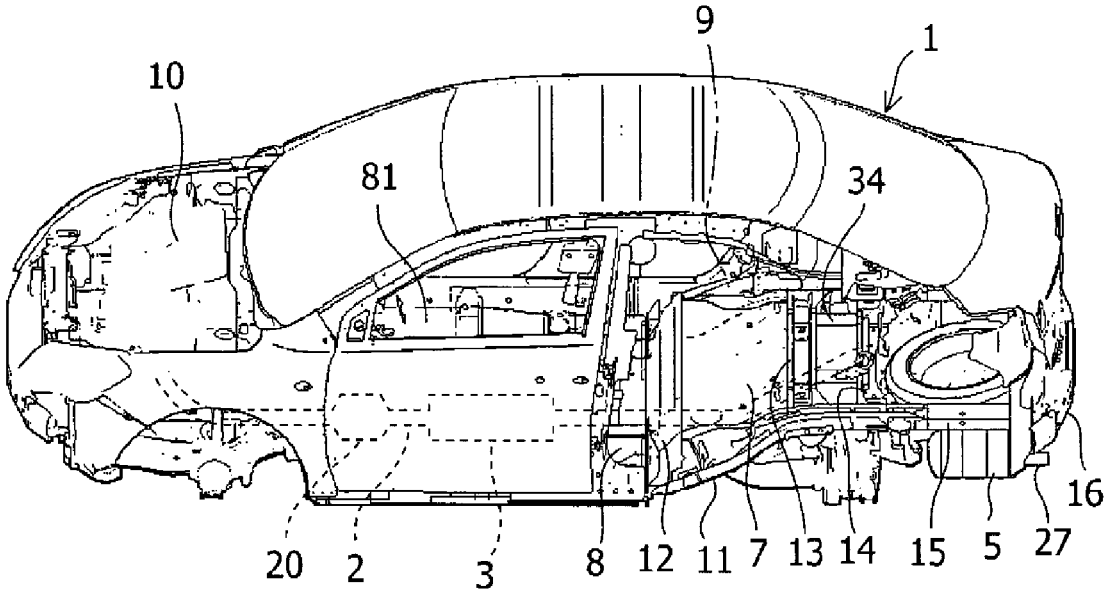
FIG. 1 is a perspective view of a vehicle to which an exhaust pipe structure in accordance with the present invention is applied, viewed from the upper side, showing a state in which a rear door and a quarter panel are removed.

FIG. 1 is a perspective view of a vehicle 1 to which an exhaust pipe structure in accordance with the present invention is applied, viewed from the left-hand upper side, showing a state in which a rear door, a quarter panel, and a rear floor panel 9 are removed. In FIG. 1, the vehicle 1 is a front engine vehicle mounted with an engine 10 in the front part of a vehicle body, and also a left-hand drive vehicle on which a driver's seat 81 (FIG. 3) is positioned on the left-hand side of a cabin. On the rear of a front seat including the driver's seat 81, a rear seat, not shown, is provided. The rear floor 9 on the rear of the rear seat position is provided at a level higher than a front floor 8, and rear floor side members 11, which are structural elements in the vehicle body rear part, are disposed along both side parts of the rear floor 9.

At the rear end of each of the rear floor side members 11, a crash box 15 constituting a main shock absorbing structure in the vehicle rear part is extendingly provided. The rear ends of the right and left crash boxes 15 are connected to each other by a rear bumper member 16 extending in the vehicle width direction. Each of mufflers 5 and 6 (only the left-hand side muffler 5 is shown in FIG. 1) is suspended by a suspending means, described later, at two front and rear locations: a location near the rear end of the rear floor side member 11 and a location near the rear end of the crash box 15.

Between the right and left rear floor side members 11, three cross members 12, 13 and 14 are provided so as to be separate from each other in the vehicle longitudinal direction. The rear floor front cross member 12 positioned at the forefront extends in the vehicle width direction in a level difference part between the front floor 8 and the rear floor 9, rising tiltingly from the rear end of the front floor 8, and is connected to the front end part of the rear floor 9 in the upper rear end part.

Figure 2:
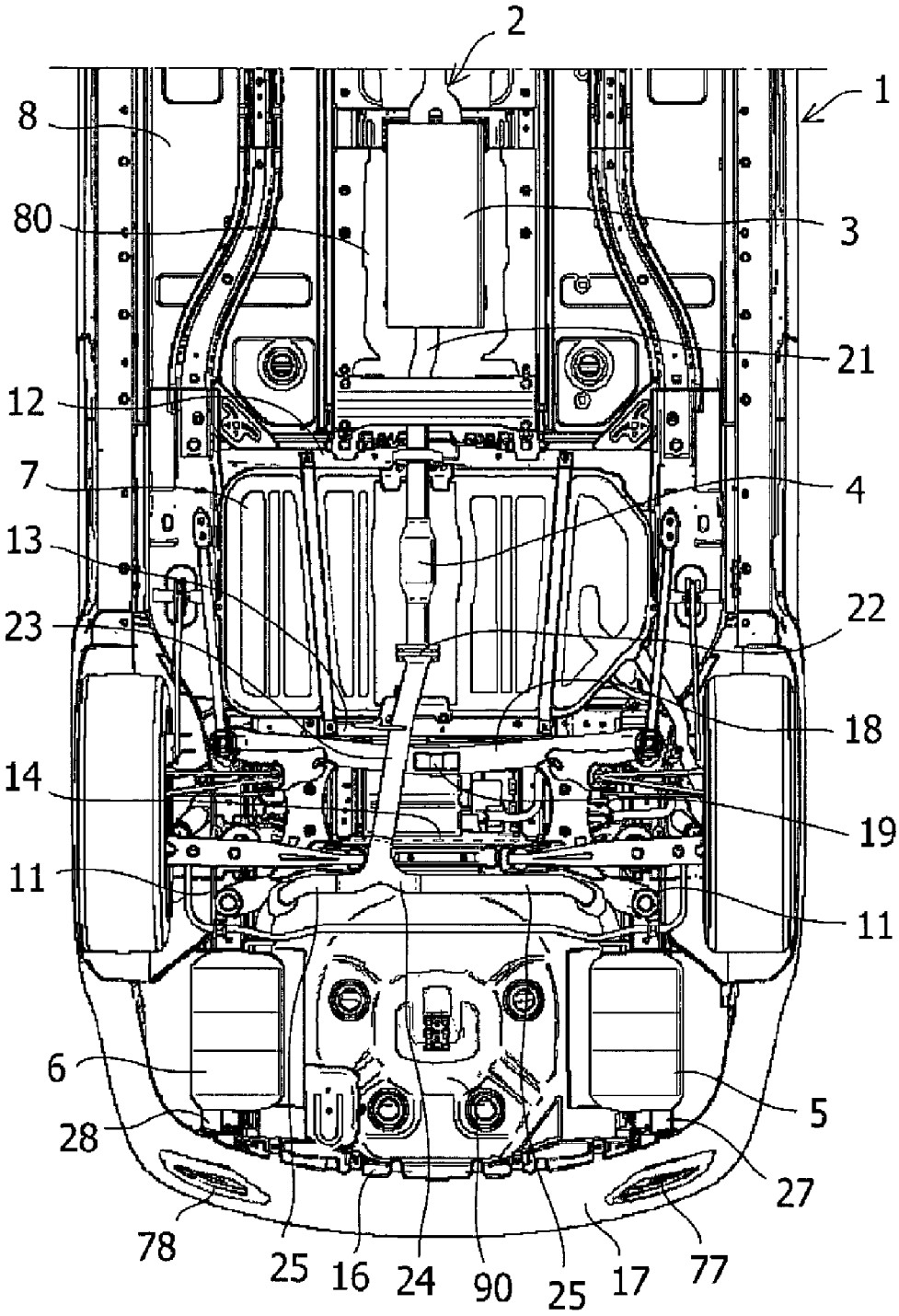
FIG. 2 is a bottom plan view of the rear part of a vehicle to which an exhaust pipe structure in accordance with the present invention is applied.

A fuel tank 7 is provided in a space under the rear floor 9 under the rear seat, which space is defined between the rear floor front cross member 12 and the rear floor center cross member 13 positioned on the rear thereof. As shown in FIG. 2, the fuel tank 7 is supported on the lower side of the rear floor 9 with two belts set between the rear floor front cross member 12 and the rear floor center cross member 13.

The rear floor center cross member 13 and rear floor rear cross member 14 positioned on the rear thereof are connected to each other by rear floor cross member braces 34 provided at two locations at right and left. As shown in FIG. 2, on the lower side of the rear floor center cross member 13 and the rear floor rear cross member 14, a sub frame 18 pivotally supporting a suspension arm for rear wheels is provided. The sub frame 18 is formed into a double cross shape, and a jack-up point 19 is provided in the center in the vehicle width on the lower surface thereof.

FIG. 2 is a bottom plan view of the rear part of the vehicle 1 to which the exhaust pipe structure in accordance with the present invention is applied. An exhaust pipe 2 (21) collected by an exhaust manifold of the engine 10 shown in FIG. 1 extends linearly in a floor tunnel 80 under the lower surface in the center of the vehicle body as shown in FIG. 2 through a primary catalyst 20 (FIG. 1), being connected to a secondary catalyst 3 disposed in the floor tunnel 80, and is connected to a sub muffler 4 (primary silencer) under the fuel tank 7.

The exhaust pipe 21 is connected to an oblique part 23 via a ball joint 22 at a position near the rear end of the fuel tank 7 on the downstream side of the sub muffler 4. The oblique part 23 bends just behind the ball joint 22, being laid slantwise toward a branch part 24 offset to the driver's seat 81 side (the left-hand side in the figure) with respect to the center in the vehicle width direction, and branches into left and right branch pipes 25 and 26 in the branch part 24.

The branch pipes 25 and 26 extend linearly from the branch part 24 toward both the left and right sides, being bent to the upper rear in front of the left and right mufflers 5 and 6, and are connected to the front ends of the mufflers 5 and 6, respectively. The tip end parts of tail pipes 27 and 28 extending rearward from the rear ends of the mufflers 5 and 6 are open so as face to left and right openings 77 and 78 penetrating a rear bumper 17 (bumper fascia), so that exhaust gas can be exhausted to the rear of the vehicle 1 through the openings 77 and 78.

Figure 4:
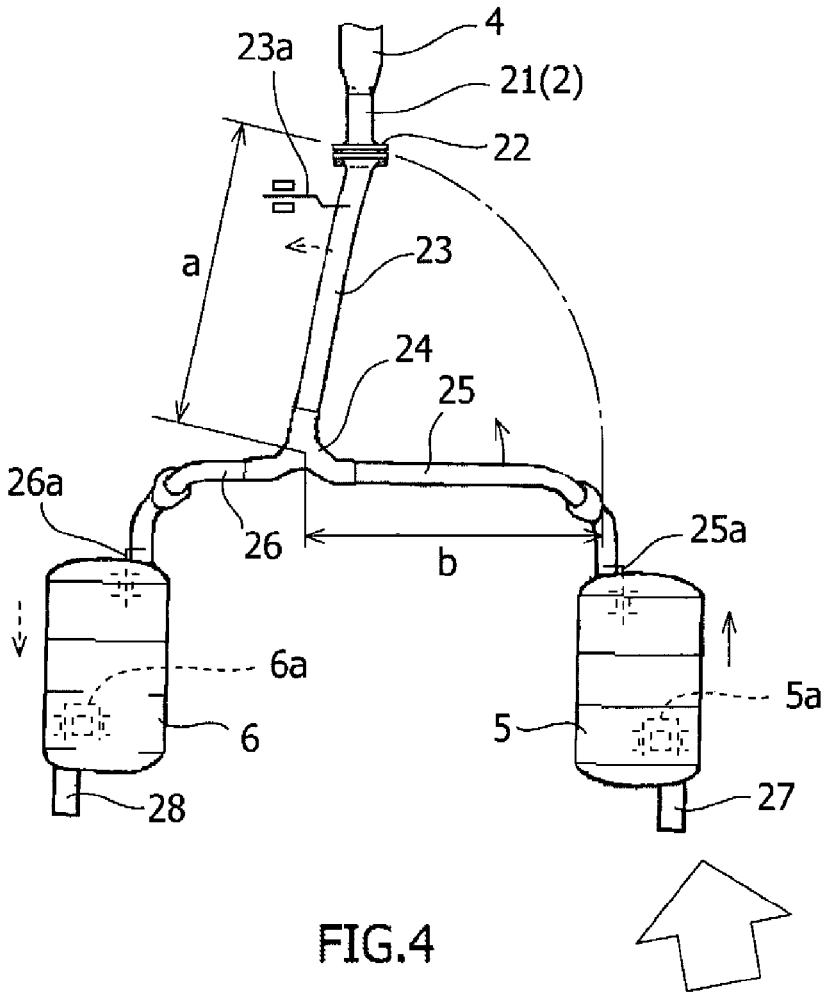
FIG. 4 is a bottom plan view of an essential portion, showing an exhaust pipe structure in accordance with the present invention.

FIG. 4 shows an exhaust pipe layout in the rear part of the vehicle 1. As shown in FIG. 4, in the exhaust pipe structure in accordance with the present invention, of the left and right branch pipes 25 and 26, the longer branch pipe 25 extending to the left-hand side in the vehicle width direction (the right-hand side in FIG. 4) is configured so that the length b (distance in the vehicle width direction) of the main part thereof extending linearly in the vehicle width direction from the branch part 24 is set so as to be approximately equal to the length a (direct distance) of the oblique part 23.

On the other hand, as shown in FIG. 2, the oblique part 23 of the exhaust pipe 2 is laid so as to stride across the sub frame 18 longitudinally, and the left and right branch pipes 25 and 26 are laid in the vehicle width direction along the front part of a spare tire housing 90 positioned on the rear of the sub frame 18. As a suspending means for the exhaust pipe 2 in this part, as shown in FIG. 4, a hanger 23*a* is fixed to a portion close to the front part of the oblique part 23, hangers 25*a* and 26*a* are fixed to connecting parts between the left and right branch pipes 25 and 26 and the corresponding mufflers 5 and 6, and further hangers 5*a* and 6*a* are fixed to the rear upper parts of the left and right mufflers 5 and 6, respectively.

The hanger 23*a* of the oblique part 23 is attached to a bracket provided in the lower part of the rear floor center cross member 13 (FIG. 2) in the state in which the movement thereof in the vehicle width direction is allowed. In contrast, the hangers 25*a* and 26*a* of the left and right branch pipes 25 and 26 are attached to brackets provided at positions near the rear ends of the left and right rear floor side members 11 in the state in which the movement thereof in the vehicle longitudinal direction is allowed, and the hangers 5*a* and 6*a* of the left and right mufflers 5 and 6 are attached to brackets provided at positions near the rear ends of the left and right crash boxes 15. As a suspending means for allowing the movement of each hanger, an elastic suspension in which an elastic member is interposed between the hanger and the bracket on the vehicle body side, and the elastic deformation or the rotation thereof is utilized can be used.

Figure 3:
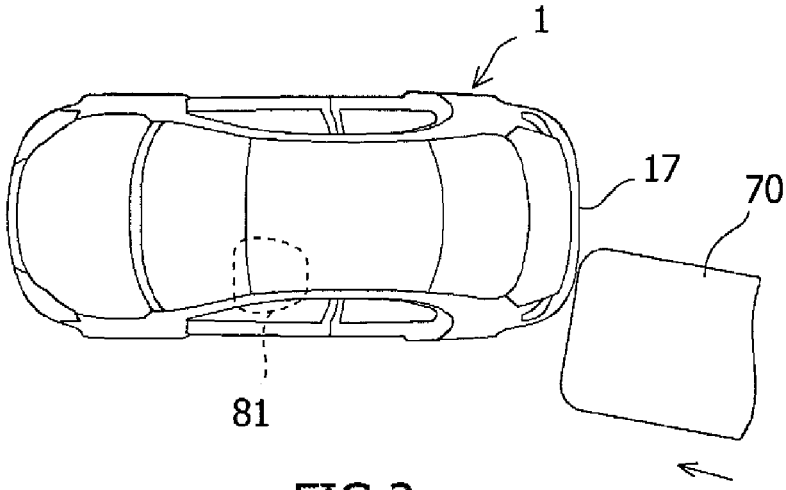
FIG. 3 is a plan view showing a state in which a shock load is applied to the vehicle body rear part from the slantwise rear.

As already described, when the vehicle is subjected to a rear end collision by another running vehicle, the possibility of offset collision from the side rear of the driver's seat or from the slantwise rear is high. For example, as shown in FIG. 3, in the case in which a vehicle 70 running at a high speed on a driving lane collides from behind with the vehicle 1 (left-hand drive vehicle) merging at an entrance ramp from the right-hand side on an express highway of right-side driving or the like, or in the case in which the succeeding vehicle 70 (barrier of collision test machine) collides from behind with the vehicle 1 stopping on the right shoulder of a road of right-side driving, the vehicle 1 is subjected to a shock load from the slantwise rear on the driver's seat 81 side of the vehicle body rear part.

In this case, when the shock load is applied to the tail pipe 27 and the muffler 5 on the driver's seat 81 side as shown in the bottom plan view of FIG. 4, a moment that turns the branch pipe 25 forward with the branch part 24 being the center is produced, and accordingly a moment that turns the oblique part 23 of the exhaust pipe 2 to the side with the branch part 24 being the center is produced.

Taking the displacement of the muffler 5 as x and the length of the branch pipe 25 as b, the rotation angle θ at this time is expressed as $$\theta = a\tan(x/b)$$

Therefore, as the length b of the branch pipe 25 increases, the rotation angle θ decreases, and therefore damage to the branch part 24 can be reduced.

In the case in which the ratio between the length of the left branch pipe 25 and the length of the right branch pipe 26 is 2:1 as in the example shown in the figure (that is, in the case in which the length b of the left branch pipe 25 is two times the length of the right branch pipe 26), the rotation angle θ is 25% or more decreased as compared with the case in which the lengths of the left and right branch pipes 25 and 26 are equal to each other (that is, in the case in which the branch part 24 is positioned at the center in the vehicle width direction), so that the bending stress of the branch part 24 is reduced.

In the case in which the length a of the oblique part 23 is significantly shorter than the length b of the main part of the branch pipe 25, if an attempt is made to offset the branch part 24 to the same degree as in the example shown in the figure, the need to accordingly increase the inclination angle of the oblique part 23 arises. If the inclination angle of the oblique part 23 is large, in the case in which a load is applied to the muffler 5 on the branch pipe 25 side from the rear as shown in FIG. 4, by the rotation of the oblique part 23 to the side caused by the rotation of the branch pipe 25 to the front, the forward displacement component of the ball joint 22 at the front end of the oblique part 23 increases. Therefore, a tendency for the exhaust pipe 21 to be pushed out to the upstream side and damage the secondary catalyst 3 and the sub muffler 4 increases.

On the other hand, in the case in which the length a of the oblique part 23 is significantly longer than the length b of the main part of the branch pipe 25, by the rotation of the oblique part 23 to the side caused by the rotation of the branch pipe 25 to the front, the displacement of the ball joint 22 at the front end of the oblique part 23 to the side increases. Therefore, the need to secure a large clearance under the fuel tank 7 arises, so that the freedom of design is lost. Also, if an attempt is made to still offset the branch part 24 to the same degree as in the example shown in the figure, the inclination angle of the oblique part 23 decreases. Therefore, the displacement component of the exhaust pipe 21 caused by direct pushing-out to the downstream side due to the load applied from the rear increases, so that a tendency for the secondary catalyst 3 and the sub muffler 4 to be damaged increases.

For the above-described reason, the length a of the oblique part 23 is preferably set so as to be almost the same as the length b of the main part of the branch pipe 25, and the inclination angle in the horizontal plane in the installation state of the oblique part 23 is preferably set at 10 to 20 degrees with respect to the vehicle longitudinal direction. Such an exhaust pipe layout is also advantageous in that when the vehicle 1 is subjected to a rear end full overlap collision, the ball joint 22 (bend part) of the exhaust pipe 2 is displaced to the left-hand side (the right-hand side in FIG. 4), whereby the pushing-out of the exhaust pipe 21 to the upstream side can be relaxed, and therefore the damage to the secondary catalyst 3 and the sub muffler 4 can be reduced.

Also, in the case in which the aforementioned moment is produced on the branch pipe 25 and the oblique part 23 with the branch part 24 being the center, since the oblique part 23 is suspended via the hanger 23*a* in the state in which the movement thereof in the vehicle width direction is allowed, and the oblique part 23 and the exhaust pipe 21 are connected to each other via the ball joint 22 in the state in which the angular displacement thereof is allowed, the oblique part 23 and the exhaust pipe 21 can be displaced to the side (left-hand side in FIG. 4). By this displacement as well, the bending stress of the branch part 24 is reduced.

Furthermore, in the case in which the aforementioned moment is produced with the branch part 24 being the center, a relative stress toward the vehicle rear is caused on the right muffler 6 connected to the branch part 24 via the branch pipe 26. However, since the branch pipe 26 and the muffler 6 are suspended via the hanger 26*a* and 6*a*, respectively, so that the movement thereof in the vehicle longitudinal direction is allowed, the branch pipe 26 and the muffler 6 can be displaced to the vehicle rear. By this displacement as well, the bending stress of the branch part 24 is reduced.

Also, the exhaust pipe 2 of the present invention is configured so that the oblique part 23 is laid slantwise toward the branch part 24 offset to the left with respect to the center in the vehicle width direction. Therefore, the provision of the jack-up point 19 in the center in the vehicle width direction of the sub frame 18 is not hindered, and also the access to a jack placed at the jack-up point 19 is made easy, so that this configuration is advantageous in performing jacking-up operation.

The above is a description of one embodiment of the present invention. The present invention is not limited to the above-described embodiment, and various modifications and changes can be made based on the technical concept of the present invention.

What is claimed is:

1. An exhaust pipe structure for a vehicle, comprising:

mufflers disposed on both right and left sides in the rear end part of the vehicle;

an exhaust pipe extending from an exhaust manifold of an engine mounted in the front part of the vehicle to a branch part in the rear part of the vehicle through a portion under a fuel tank disposed under a rear seat; and right and left branch pipes extending from the branch part to the right and left mufflers, wherein the branch part is arranged so as to be offset to the side of either one of the right and left mufflers with respect to the center in the vehicle width direction; the exhaust pipe has an upstream part that extends from the exhaust manifold to a bend part positioned in the center in the vehicle width direction near the rear end of the fuel tank and is laid linearly in the center in the vehicle width direction at least in a section ranging from a floor front end part to the bend part, and an oblique part laid slantwise from the bend part toward the branch part; and the length of the branch pipe having a longer distance to the corresponding muffler is approximately equal to the length of the oblique part.

2. The exhaust pipe structure according to claim 1, wherein the main part of each of the branch pipes, which is connected to the branch part, is laid linearly in the vehicle width direction.

3. The exhaust pipe structure according to claim 2, wherein the branch part is arranged so as to be offset to the side opposite to a driver's seat with respect to the center in the vehicle width direction; and the length of the branch pipe having a longer distance laid on the driver's seat side is approximately equal to the length of the oblique part.

4. The exhaust pipe structure according to claim 1, wherein the exhaust pipe is connected in the bend part or in the vicinity thereof via a pipe joint which allows angular displacement of the exhaust pipe.

5. The exhaust pipe structure according to claim 4, wherein the right and left mufflers and the right and left branch pipes are suspended so as to be displaceable in the longitudinal direction to allow rotational displacement in the horizontal plane with the branch part being the center.

6. The exhaust pipe structure according to claim 5, wherein the branch part is arranged so as to be offset to the side opposite to a driver's seat with respect to the center in the vehicle width direction; and the length of the branch pipe having a longer distance laid on the driver's seat side is approximately equal to the length of the oblique part.

7. The exhaust pipe structure according to claim 4, wherein the branch part is arranged so as to be offset to the side opposite to a driver's seat with respect to the center in the vehicle width direction; and the length of the branch pipe having a longer distance laid on the driver's seat side is approximately equal to the length of the oblique part.

8. The exhaust pipe structure according to claim 1, wherein the branch part is arranged so as to be offset to the side opposite to a driver's seat with respect to the center in the vehicle width direction; and the length of the branch pipe having a longer distance laid on the driver's seat side is approximately equal to the length of the oblique part.

* * * * *